US012618247B2

(12) United States Patent
Oh et al.

(10) Patent No.: US 12,618,247 B2
(45) Date of Patent: May 5, 2026

(54) SCAFFOLD STORAGE STRUCTURE

(71) Applicant: WERNER CO., Greenville, PA (US)

(72) Inventors: Sang Oh, Lake Zurich, IL (US); Michael Gong, Hoffman Estates, IL (US); Robert A. Bergum, Woodstock, IL (US)

(73) Assignee: Werner Co., Itasca, IL (US)

( * ) Notice: Subject to any disclaimer, the term of this patent is extended or adjusted under 35 U.S.C. 154(b) by 705 days.

(21) Appl. No.: 17/985,540

(22) Filed: Nov. 11, 2022

(65) Prior Publication Data

US 2023/0203826 A1 Jun. 29, 2023

Related U.S. Application Data

(60) Provisional application No. 63/278,808, filed on Nov. 12, 2021.

(51) Int. Cl.

| | |
|---|---|
| ***E04G 5/00*** | (2006.01) |
| *E04G 1/24* | (2006.01) |
| *E04G 1/30* | (2006.01) |

(52) U.S. Cl.

CPC ..... *E04G 5/003* (2013.01); *E04G 2001/242* (2013.01); *E04G 2001/305* (2013.01)

(58) Field of Classification Search

CPC ... E04G 5/003; E04G 5/004; E04G 2001/305; B25H 1/12; B25H 3/00; B25H 3/04; E06C 1/005

See application file for complete search history.

(56) References Cited

U.S. PATENT DOCUMENTS

| | | | | |
|---|---|---|---|---|
| 1,649,065 | A * | 11/1927 | Jarvis | B62B 3/00 312/282 |
| 3,856,371 | A * | 12/1974 | Forsyth | A47B 17/003 108/26 |
| 5,706,741 | A * | 1/1998 | Thorp | A47B 87/0215 211/208 |
| 5,722,544 | A * | 3/1998 | Williams | A47B 87/008 211/186 |
| 6,036,203 | A * | 3/2000 | Tyus | B25H 3/00 280/47.26 |
| 6,764,144 | B2 * | 7/2004 | Insalaco | A47B 47/00 312/257.1 |
| 6,820,878 | B2 * | 11/2004 | Safari | A61B 50/18 16/114.1 |
| 6,981,751 | B2 * | 1/2006 | Powell | A47B 47/05 312/265.3 |

(Continued)

*Primary Examiner* — Colleen M Chavchavadze
(74) *Attorney, Agent, or Firm* — Michael Best & Friedrich LLP

(57) ABSTRACT

A storage structure for a scaffold is disclosed. In one embodiment, the storage structure includes at least one back panel, at least two side panels, and at least one door. The at least one back panel and the two side panels are configured to be affixed to the frame of a scaffold, and the at least one door is rotatably affixed to one of the two side panels. When the panels and the door are secured to the frame of the scaffold, an interior is defined having sides formed by the panels and door, and a top and a bottom each formed by horizontal decks of the scaffold. The panels and door hook and clamp into place on existing scaffold structures, and do not require that the scaffold be modified.

20 Claims, 8 Drawing Sheets

(56) References Cited

U.S. PATENT DOCUMENTS

| | | | | |
|---|---|---|---|---|
| 7,114,733 | B2 * | 10/2006 | Downs | B62B 3/02 280/47.35 |
| 7,392,993 | B1 * | 7/2008 | Prohl | B62B 3/002 280/639 |
| 7,909,685 | B2 * | 3/2011 | Heim, Sr. | B25H 3/02 454/184 |
| 8,474,576 | B2 * | 7/2013 | Renish | E04G 1/15 206/372 |
| 9,084,484 | B2 * | 7/2015 | Vilkomirski | A47B 87/0223 |
| 9,301,603 | B1 * | 4/2016 | Koehn | A47B 47/00 |
| 9,669,768 | B1 * | 6/2017 | Raper | B60R 7/10 |
| 10,165,854 | B2 * | 1/2019 | Lim | F16B 12/34 |
| 2001/0045718 | A1 * | 11/2001 | Boirum | E04G 5/00 280/638 |

* cited by examiner

SCAFFOLD STORAGE STRUCTURE

CROSS REFERENCE TO RELATED APPLICATIONS

The claims priority to U.S. Provisional Patent Application No. 63/278,808 filed Nov. 12, 2021. The entire disclosure contents of this application are herewith incorporated by reference into the present application.

BACKGROUND

A. Field

This disclosure relates generally to storage structures and scaffolding, and more particularly to a secure storage attachment structure for a scaffold.

B. Description of Related Art

Scaffolds, such as rolling scaffolds, are frequently used throughout construction and restoration projects, and generally comprise a modular metal structure having a base having wheels to move the scaffold along the ground, stabilizers to immobilize the scaffold while in a working position, and vertical posts and multiple decks positioned along the height of the posts.

Any tools, equipment, construction-related plans, or personal items that may be used on a scaffold at a worksite are exposed to the environment, and it is generally unadvisable to leave such items on an unattended deck for an extended period of time, where they may be subjected to rain, wind, and snow, or may be stolen.

Thus, items used on a scaffold deck are removed on a daily basis to protect and guard the items. The regular removal and bringing back of the items to a scaffold can become a cumbersome process.

SUMMARY

The following embodiments and aspects thereof are described and illustrated in conjunction with systems, tools and methods which are meant to be exemplary and illustrative, not limiting in scope.

In one aspect, a storage structure for a scaffold is disclosed. The storage structure comprises at least one back panel, at least two side panels, and at least one door. The at least one back panel and the at least two side panels are configured to be affixed to a frame of a scaffold, and the at least one door is rotatably affixed to one side panel of the at least two side panels. When the at least one back panel, the at least two side panels, and the at least one door are secured to the frame of the scaffold, an interior is defined having sides formed by the at least one back panel, the at least two side panels, and the at least one door and a top and a bottom each formed by horizontal decks of the scaffold.

In an additional aspect, a method of securing a storage structure on a scaffold is disclosed. The method includes securing at least one back panel, at least two side panels, and at least one door to a frame of the scaffold by affixing the at least one back panel and the at least two side panels to the frame of the scaffold. The at least one door is rotatably affixed to one side panel of the at least two side panels. When the at least one back panel, the at least two side panels, and the at least one door are secured to the frame of the scaffold, an interior is defined having sides formed by the at least one back panel, the at least two side panels, and the at least one door, and a top and a bottom each formed by horizontal decks of the scaffold.

In addition to the exemplary aspects and embodiments described above, further aspects and embodiments will become apparent by reference to the drawings and by study of the following detailed description.

BRIEF DESCRIPTION OF THE DRAWINGS

Exemplary embodiments are illustrated in the drawings. It is intended that the embodiments and figures disclosed herein are to be considered illustrative rather than restrictive.

DETAILED DESCRIPTION

A storage structure for a scaffold is disclosed. In one embodiment, the storage structure comprises a plurality of panels and doors that are affixed to the scaffold structure so as to form sidewalls extending between at least two horizontal decks of the scaffold. The panels and doors, when assembled, along with a top horizontal deck and a bottom horizontal deck, form a secure enclosure on the scaffold. The panels and doors hook and clamp into place on existing scaffold structures, and do not require that the scaffold be modified.

The secure storage structure allows for items to be left on an unattended deck for an extended period of time, protected from the elements.

Figure 1A:
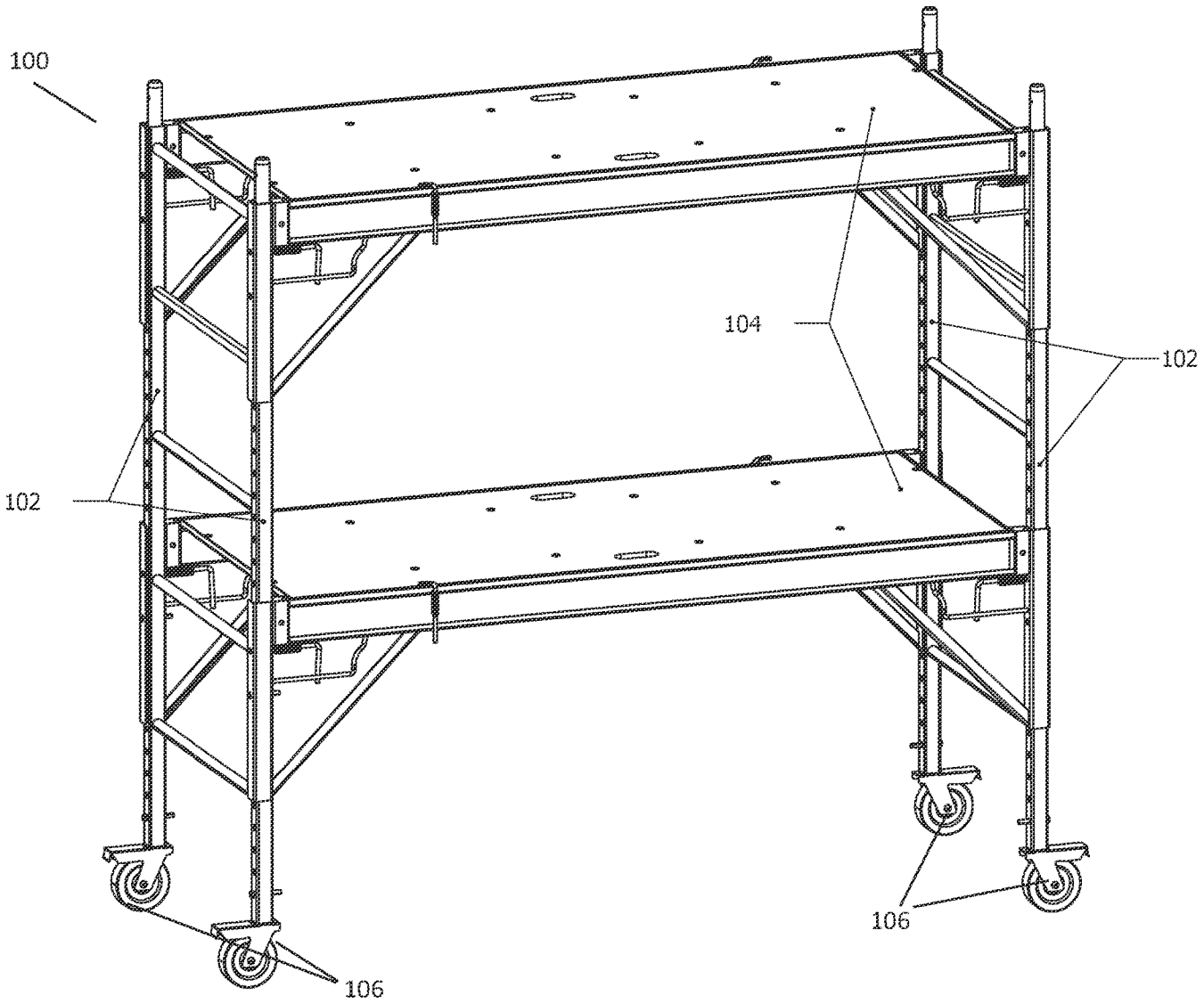
FIG. 1A is a perspective view of an example scaffold, in accordance with an embodiment.

FIG. 1A is a perspective view of a scaffold 100, in accordance with an embodiment. In some embodiments, the scaffold 100 may be a rolling scaffold. In the embodiment shown in FIG. 1A, scaffold 100 includes four vertical posts 102 and two horizontal decks 104. Additional vertical posts and horizontal decks may be contemplated. Wheels 106 are connected to the four vertical posts 102. The scaffold 100 provides for mobility and is suited for work at low or medium heights, inside or outside buildings. In one embodiment, the scaffold 100 may be a baker style scaffold.

Figure 1B:
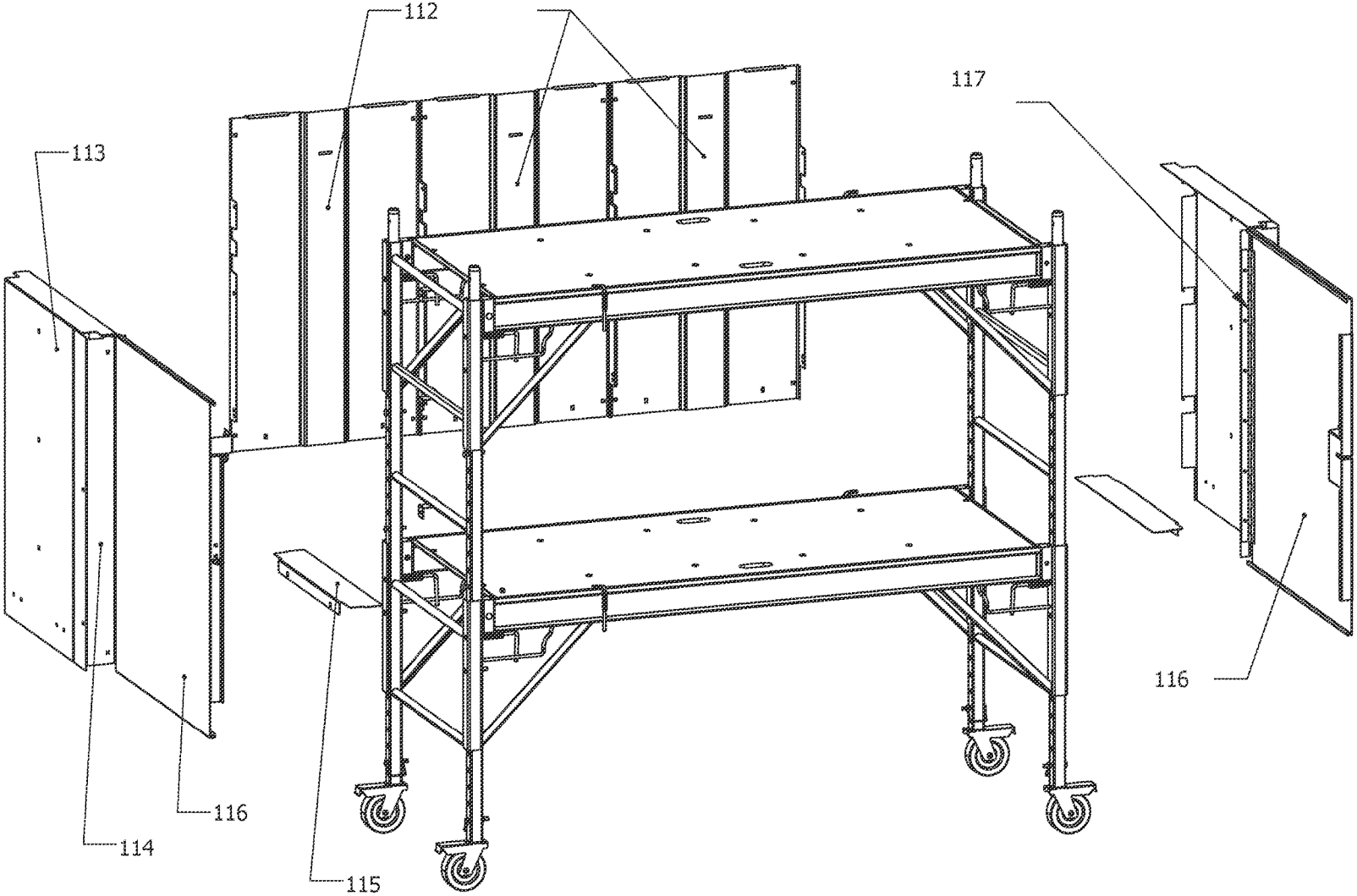
FIG. 1B is an exploded view of an example storage structure to be assembled on the scaffold of FIG. 1A, in accordance with an embodiment.

FIG. 1B is an exploded view of an example storage structure 110 to be assembled on the scaffold 100 of FIG. 1A, in accordance with an embodiment. The storage structure 110 comprises a plurality of panels, namely back panels 112, side panels 113, hinge panels 114, floor panels 115, and two doors 116, all of which are attachable to the scaffold 100. Each of the two doors 116 is connected to a hinge panels 114 via a hinge 117. In some embodiments, the hinge 117 may be a piano hinge.

In the embodiment of FIG. 1B, three back panels 112 are shown; however, there may be fewer or more back panels 112 depending on the size of the back panels 112 or the length of the scaffold 100. FIG. 1B also shows two side panels 113, each of which extend along the sides of the scaffold 100. The heights of each of the back panels 112 and the side panels 113 are shown to be the same in FIG. 1B, and to extend from the upper horizontal deck to the lower horizontal deck of the scaffold 100.

Figure 2A:
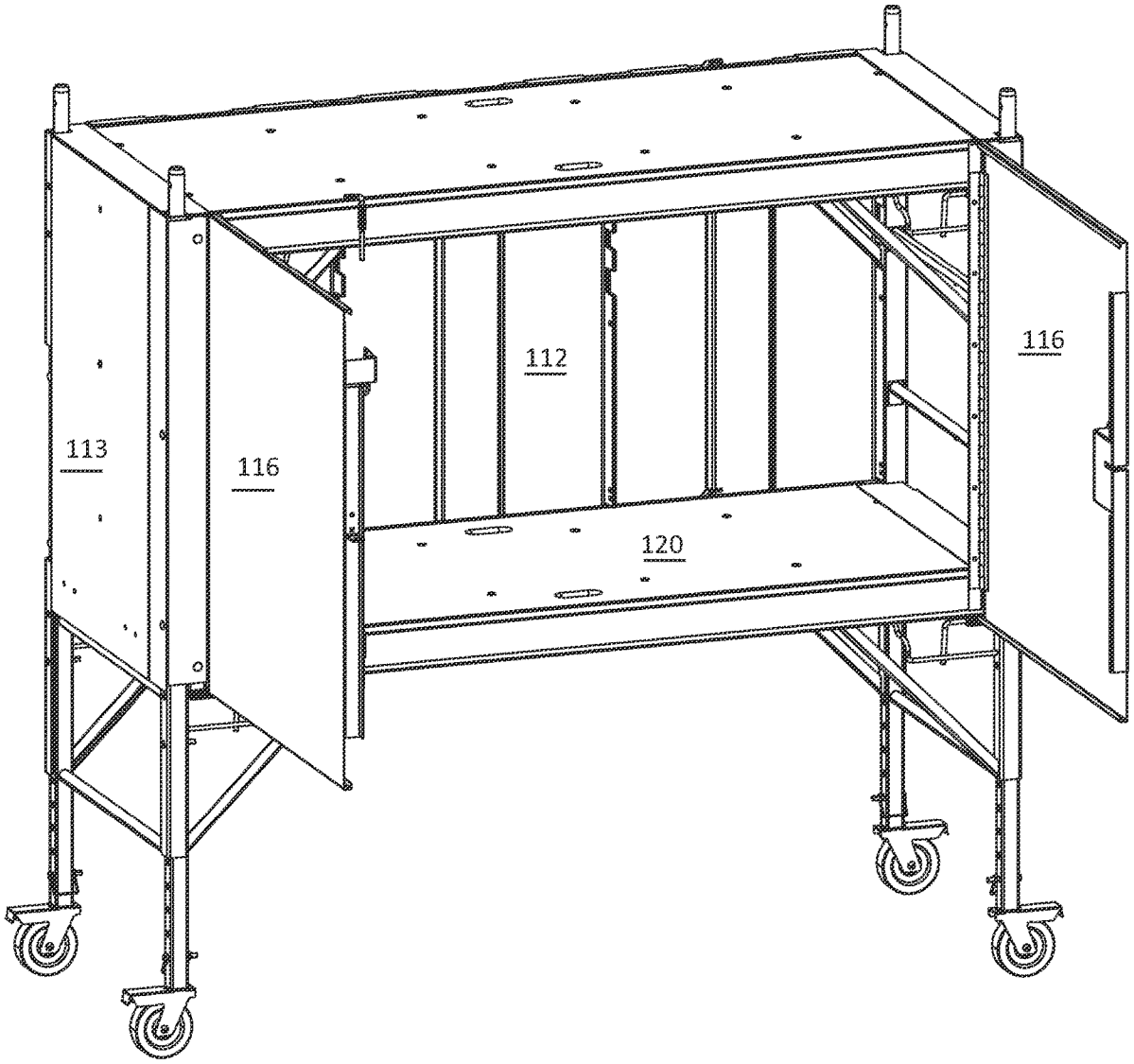
FIG. 2A is a perspective view of the assembled storage structure and scaffold of FIG. 1B, with the storage structure doors in an open position, in accordance with an embodiment.

FIG. 2A is a perspective view of the assembled storage structure 110 and scaffold 100 of FIG. 1B, with the two doors 116 in an open position, in accordance with an embodiment. As shown in FIG. 2A, when the back panels 112, side panels 113, hinge panels 114, and floor panels 115 are assembled onto the scaffold 100, a securable structure defining an interior 120 is formed wherein the panels and doors serve as the walls of the structure, and each of the two horizontal decks 104 serves as the floor and the ceiling (or top and bottom) of the structure. The two doors 116 can open to allow access into the interior 120.

Figure 2B:
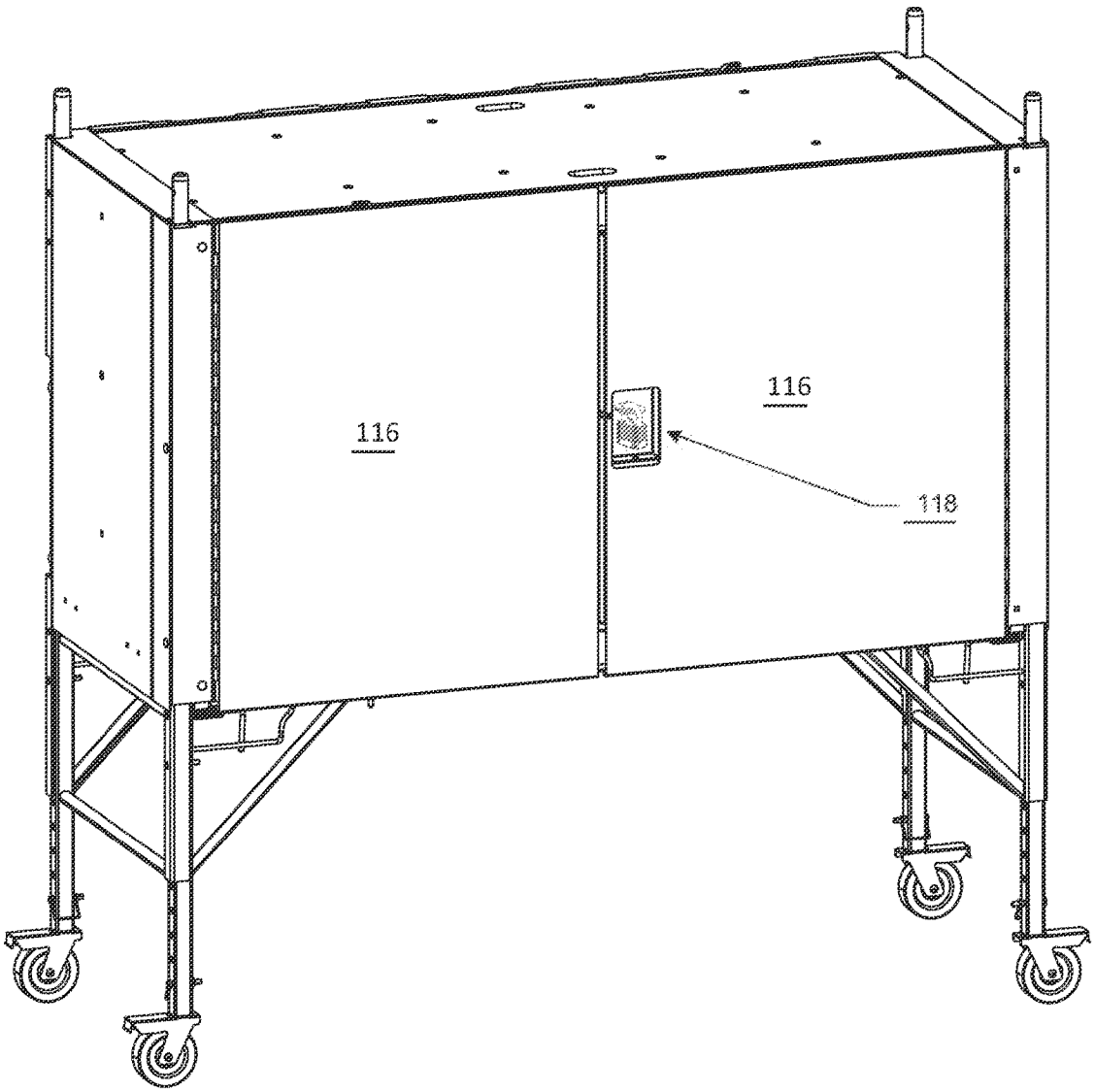
FIG. 2B is a perspective view of the assembled storage structure of FIG. 2A with the storage structure doors in a closed and locked position, in accordance with an embodiment.

FIG. 2B is a perspective view of the assembled storage structure of FIG. 2A with the storage structure doors 116 in a closed and locked position, in accordance with an embodiment. In the embodiment shown in FIG. 2B, when the two doors 116 are closed, the interior 120 between the two horizontal decks 104 is completely and securely enclosed. In some embodiments, storage structure doors 116 are configured to couple with each other by a locking mechanism 118 such that the locking mechanism secures the interior 120. As such, the interior 120 enables a secure storage structure that allows for items to be left on an unattended deck for an extended period of time. In some embodiments, the locking mechanism 118 can be a padlock, a deadbolt, a knob lock, a cam lock, a keypad lock, a smart lock, or the like.

It should be understood that the storage structure 110 may be configured to store tools and other equipment, as well as to accommodate a number of electronic components such as, for example, a flat screen television or monitor, a computer, a printer, a keyboard, and a mouse. The location of each component in the storage structure 110 may vary depending upon the needs of the contractor or tradesperson.

Figure 3:
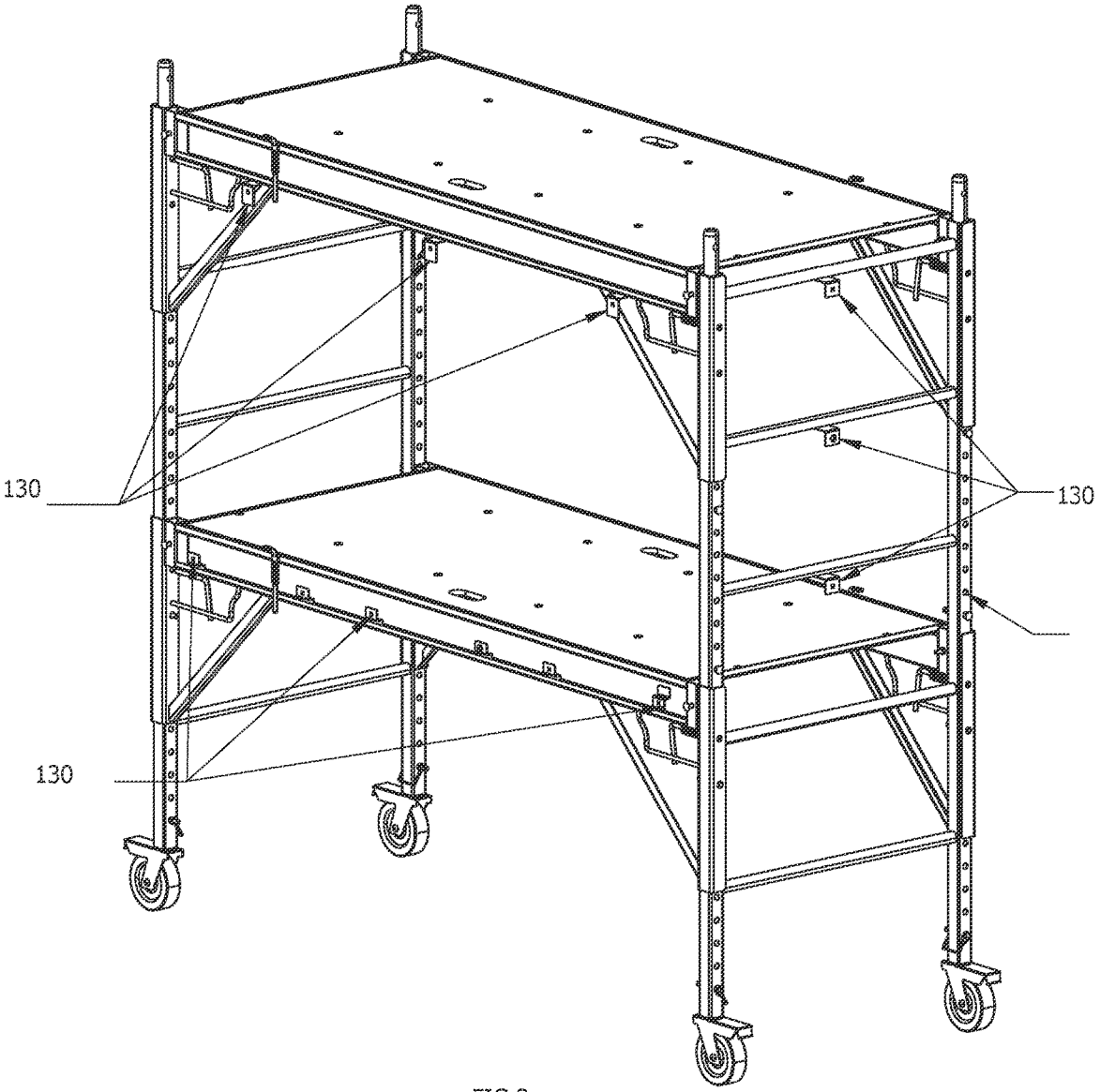
FIG. 3 is a perspective view of the rear of the scaffold of FIG. 1A, showing attachment brackets to affix panels to the scaffold, in accordance with an embodiment.

FIG. 3 is a perspective view of the rear of the scaffold 100 of FIG. 1A, showing attachment brackets 130 to affix panels to the scaffold 100, in accordance with an embodiment. In some embodiments, the attachment brackets 130 are secured to a frame of the scaffold 100 by one or more fasteners, including nuts and bolts.

Figure 4A:
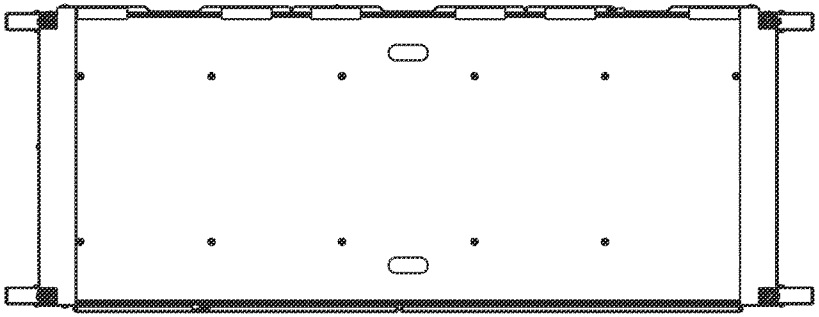
FIGS. 4A-C are top, side, and front views of the assembled storage structure of FIG. 2B, in accordance with an embodiment.
Figure 4C:
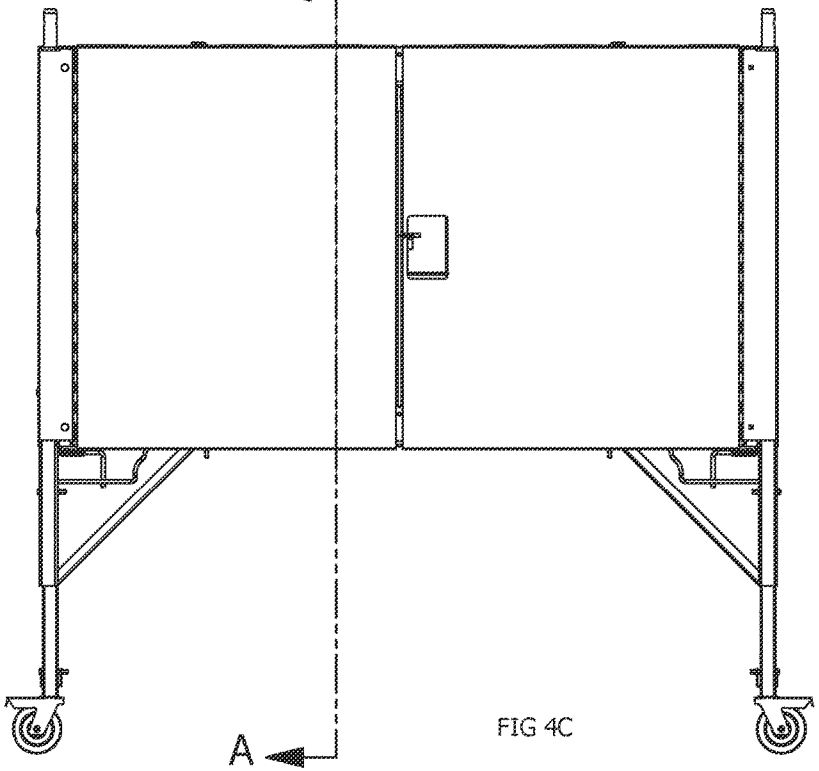
Figure 4B:
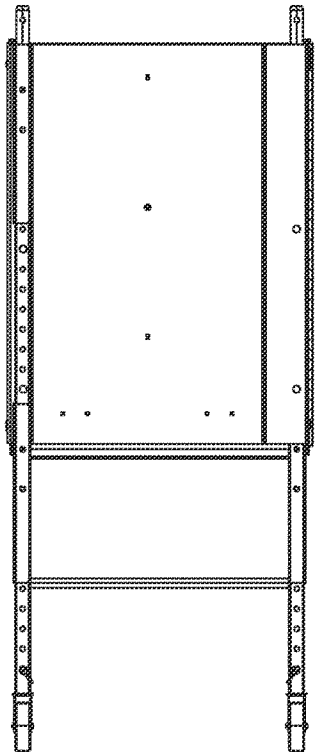

FIGS. 4A-C are top, side, and front views of the assembled storage structure of FIG. 2B, in accordance with an embodiment.

Figure 4E:
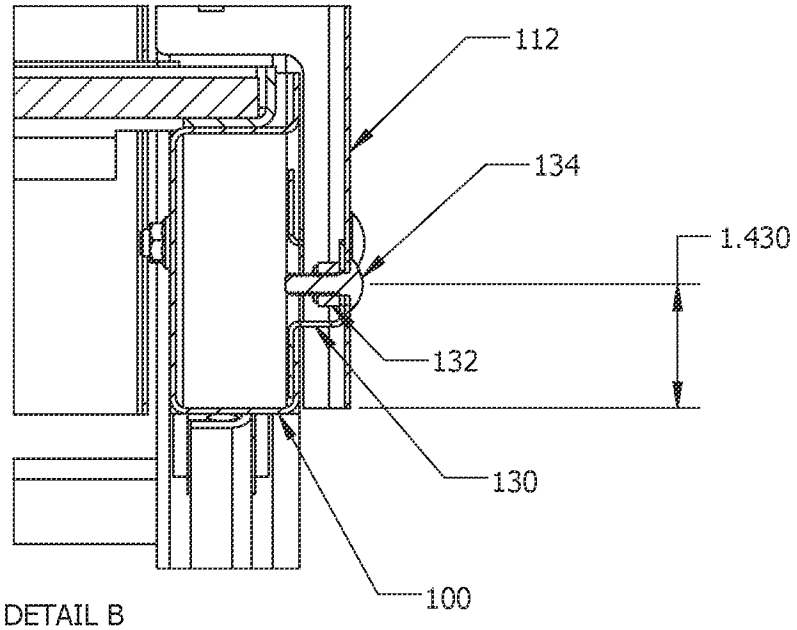
FIG. 4E is a detailed view taken from detail B in FIG. 3D, in accordance with an example embodiment.
Figure 4D:
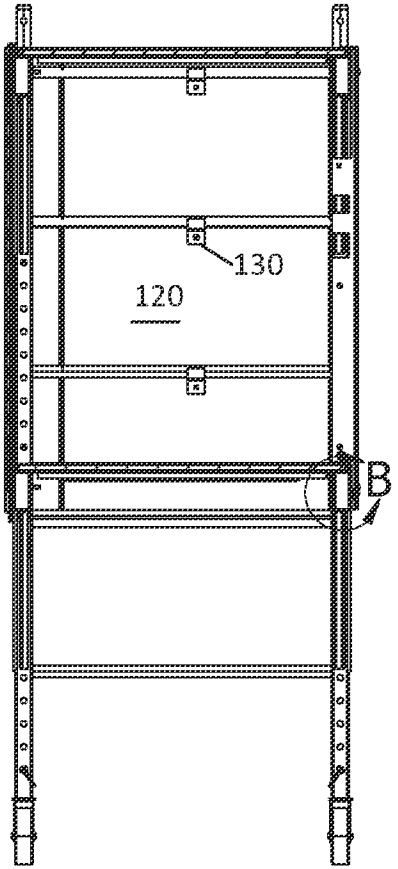
FIG. 4D is a cross-sectional view taken from A-A in FIG. 4C, in accordance with an embodiment.

FIG. 4D is a cross-sectional view taken from A-A in FIG. 4C, in accordance with an embodiment. The interior 120 of the storage structure 110 is shown, as are some attachment brackets 130 which have affixed one of the side panels 113 to the scaffold 100.

FIG. 4E is a detailed view taken from detail B in FIG. 4D, in accordance with an example embodiment. As shown in detail B, a nut 132 and bolt 134 affix one of the back panels 112 to the attachment bracket 130 on the scaffold 100.

Figure 5C:
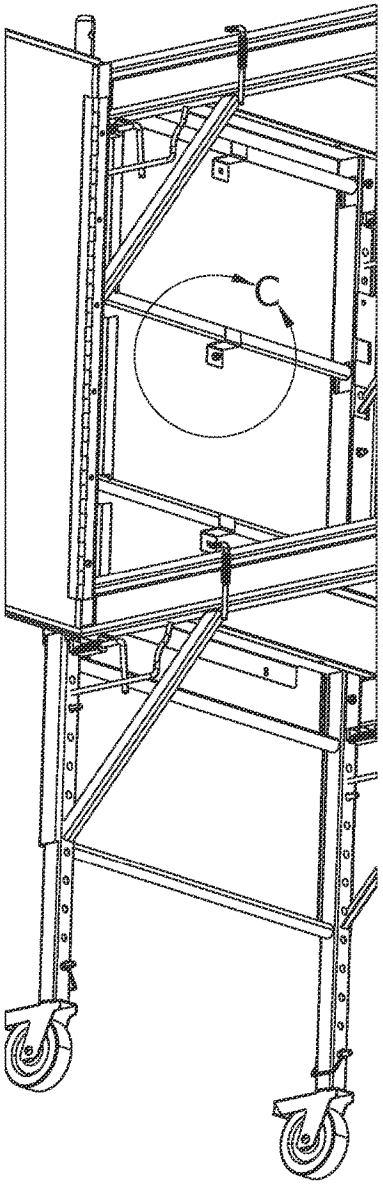
FIG. 5C is a view of the interior of the side panel and assembled storage structure of FIG. 5A, in accordance with an embodiment.
Figure 5B:
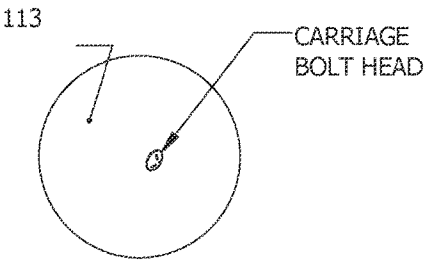
FIG. 5B is a detailed view taken from detail D in FIG. 5A, in accordance with an embodiment.
Figure 5D:
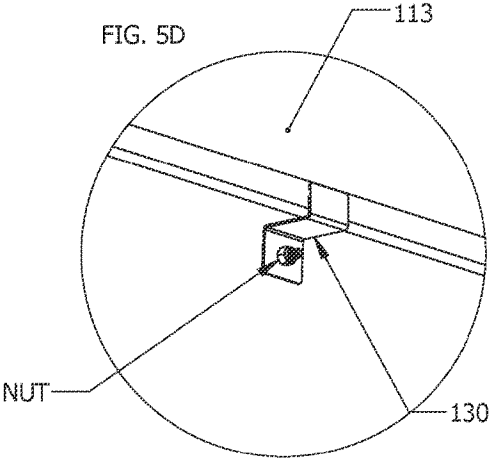
FIG. 5D is a detailed view taken from detail C in FIG. 5C, in accordance with an embodiment.
Figure 5A:
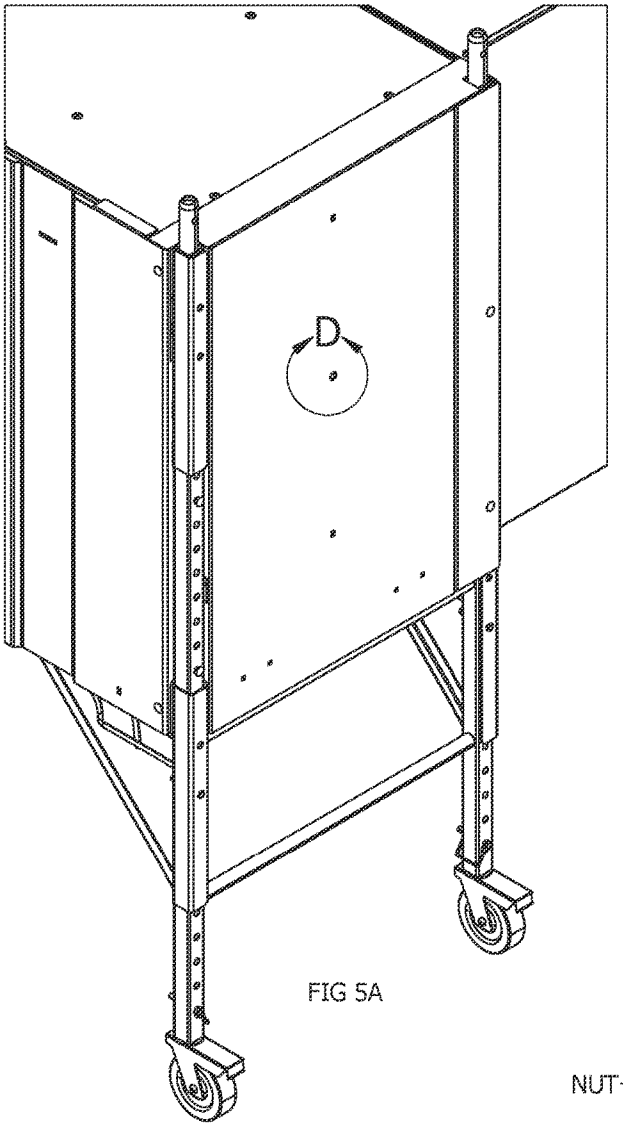
FIG. 5A is a perspective view of a side panel of the assembled storage structure and scaffold of FIG. 2A, in accordance with an embodiment.

FIG. 5A is a perspective view of a side panel 113 of the assembled storage structure 110 and scaffold 100 of FIG. 2A, in accordance with an embodiment.

FIG. 5B is a detailed view taken from detail D in FIG. 5A, in accordance with an embodiment. In the detailed view of FIG. 5B, a carriage bolt head is shown, which helps affix the side panel 113 to the frame of the scaffold 100.

FIG. 5C is a view of the interior surface of the side panel 113 and assembled storage structure 110 of FIG. 5A, in accordance with an embodiment. Attachment brackets 130 are shown, which when aligned with a nut and a bolt, such as the carriage bolt shown in FIG. 5B, affix the side panel 113 to the frame of the scaffold 100.

FIG. 5D is a detailed view taken from detail C in FIG. 5C, in accordance with an embodiment. In FIG. 5D a nut is shown aligned with a hole in the attachment bracket. Once a hole of the nut is positioned to be concentric with the hole of the attachment bracket, a bolt is driven through the hole of the attachment bracket 130 and secured via the nut.

The present application provides a number of advantages, including providing for a securable storage structure on an existing scaffold, without needing to modify the scaffold itself.

While a number of exemplary aspects and embodiments have been discussed above, those of skill in the art will recognize that still further modifications, permutations, additions and sub-combinations thereof of the features of the disclosed embodiments are still possible. It is therefore intended that the following appended claims and claims hereafter introduced are interpreted to include all such modifications, permutations, additions and sub-combinations as are within their true spirit and scope.

The invention claimed is:

1. A storage structure configured for use with a scaffold, the scaffold comprising a frame, an upper horizontal deck coupled to the frame, and a lower horizontal deck coupled to the frame, wherein each of the upper horizontal deck and lower horizontal deck create a shelf, the storage structure comprising:

a back panel;

a first side panel;

a second side panel; and a door rotatably coupled to one of the first side panel and the second side panel;

wherein the back panel is configured to be affixed to at least one of the upper horizontal deck and the lower horizontal deck, and each of the first side panel and the second side panel is configured to be affixed to at least one of the frame, the upper horizontal deck, and the lower horizontal deck;

wherein, when the back panel, the first side panel, the second side panel, and the door are secured to the scaffold, an interior is defined having sides formed by the back panel, the first side panel, the second side panel, and the door, a top formed by the upper horizontal deck, and a bottom formed by the lower horizontal deck; and wherein a hinge panel is affixed between the door and the one of the first side panel and the second side panel, wherein the hinge panel is configured to partially surround a portion of each of the frame, the upper horizontal deck, and the lower horizontal deck, and wherein the door is rotatably affixed to the hinge panel.

2. The storage structure of claim 1, wherein the door is a first door rotatably coupled to the first side panel via the hinge panel, and further comprising a second door that is rotatably coupled to the second side panel to partially define the interior.

3. The storage structure of claim 2, wherein the first door and the second door are configured to couple with each other when the back panel, the first side panel, the second side panel, the first door, and the second door are assembled.

4. The storage structure of claim 3, wherein the first door and the second door are configured to couple with each other by a locking mechanism, such that the locking mechanism secures the interior.

5. The storage structure of claim 2, wherein the hinge panel is a first hinge panel, wherein the first door is rotatably affixed to the first hinge panel via a first hinge, wherein a second hinge panel is affixed between the second door and the second side panel, and wherein the second door is rotatably affixed to the second hinge panel via a second hinge.

6. The storage structure of claim 5, wherein the first hinge and the second hinge each comprise a piano hinge.

7. The storage structure of claim 1, wherein each of the back panel, the first side panel, and the second side panel is configured to extend between the lower horizontal deck and the upper horizontal deck.

8. The storage structure of claim 1, further comprising a plurality of attachment brackets secured to the frame of the scaffold.

9. The storage structure of claim 8, wherein the plurality of attachment brackets includes a first attachment bracket configured to attach the back panel to one of the upper horizontal deck and the lower horizontal deck, a second attachment bracket configured to attach the first side panel to the frame, and a third attachment bracket configured to attach the second side panel to the frame.

10. The storage structure of claim 9, wherein each of the plurality of attachment brackets is attached to one of the back panel, the first side panel and the second side panel by a fastener.

11. The storage structure of claim 10, wherein the fastener of each of the plurality of attachment brackets includes a nut and a bolt.

12. The storage structure of claim 1, further comprising a first floor panel configured to be coupled between the lower horizontal deck and the first side panel and a second floor panel configured to be coupled between the lower horizontal deck and the second side panel.

13. The storage structure of claim 1, wherein the back panel is one of a plurality of back panels that are coupled to one another.

14. A scaffold comprising:

a frame;

an upper horizontal deck mounted onto the frame;

a lower horizontal deck mounted onto the frame, each of the upper horizontal deck and the lower horizontal deck creating a shelf;

a back panel removably affixed to at least one of the upper horizontal deck and the lower horizontal deck;

a first side panel removably affixed to at least one of the frame, the upper horizontal deck, and the lower horizontal deck;

a second side panel removably affixed to at least one of the frame, the upper horizontal deck, and the lower horizontal deck; and a door rotatably coupled to one of the first side panel and the second side panel;

wherein the upper horizontal deck, the lower horizontal deck, the back panel, the first side panel, the second side panel, and the door define an interior of a storage structure, and wherein each of the upper horizontal deck and the lower horizontal deck are configured to be mounted at different heights along a height of the frame.

15. The scaffold of claim 14, wherein the frame includes vertical posts, and further comprising a plurality of wheels, one wheel of the plurality of wheels being connected each of the vertical posts of the frame.

16. The scaffold of claim 14, wherein the door is a first door that is rotatably coupled to the first side panel, and further comprising a second door rotatably coupled to the second side panel.

17. The scaffold of claim 16, wherein the first door and the second door are configured to couple with each other by a locking mechanism, such that the locking mechanism secures the interior.

18. The scaffold of claim 14, further comprising a hinge panel affixed between the door and the one of the first side panel and the second side panel, wherein the hinge panel partially surrounds a portion of each of the frame, the upper horizontal deck, and the lower horizontal deck, and wherein the door is rotatably affixed to the hinge panel.

19. A scaffold comprising:

a frame;

an upper horizontal deck mounted onto the frame;

a lower horizontal deck mounted onto the frame, each of the upper horizontal deck and the lower horizontal deck creating a shelf;

a back panel removably affixed to at least one of the upper horizontal deck and the lower horizontal deck;

a first side panel removably affixed to at least one of the frame, the upper horizontal deck, and the lower horizontal deck;

a second side panel removably affixed to at least one of the frame, the upper horizontal deck, and the lower horizontal deck; and a door rotatably coupled to one of the first side panel and the second side panel;

wherein the upper horizontal deck, the lower horizontal deck, the back panel, the first side panel, the second side panel, and the door define an interior of a storage structure, and wherein a hinge panel is affixed between the door and the one of the first side panel and the second side panel, wherein the hinge panel partially surrounds a portion of each of the frame, the upper horizontal deck, and the lower horizontal deck, and wherein the door is rotatably affixed to the hinge panel.

20. The scaffold of claim 19, wherein the frame includes vertical posts, and further comprising a plurality of wheels, one wheel of the plurality of wheels being connected each of the vertical posts of the frame.

* * * * *